United States Patent [19]

Oei et al.

[11] Patent Number: 4,824,490

[45] Date of Patent: Apr. 25, 1989

[54] PROCESS OF PRODUCING PHOSPHATE COATINGS ON METALS

[75] Inventors: Han Yong Oei, Frankfurt am Main; Günter Siemund, Heusenstamm; Rudolf Vey, Bad Vilbel, all of Fed. Rep. of Germany

[73] Assignee: Metallgesellschaft Aktiengesellschaft, Frankfurt am Main, Fed. Rep. of Germany

[21] Appl. No.: 110,949

[22] Filed: Oct. 20, 1987

[30] Foreign Application Priority Data

Oct. 25, 1986 [DE] Fed. Rep. of Germany ..... 3636390

[51] Int. Cl.[4] ..... C23C 22/17; C23C 22/86

[52] U.S. Cl. ..... 148/259; 148/262; 148/263

[58] Field of Search ..... 148/6.15 Z

[56] References Cited

U.S. PATENT DOCUMENTS

| | | | |
|---|---|---|---|
| 2,479,564 | 8/1949 | Gilbert | 148/6.15 Z |
| 2,850,418 | 9/1958 | Otto | 148/6.15 Z |
| 3,166,444 | 1/1965 | Ehren | 148/6.15 Z |
| 3,338,755 | 8/1967 | Jenkins | 148/6.15 Z |
| 3,860,455 | 1/1975 | Hansen et al. | 148/6.15 Z |

FOREIGN PATENT DOCUMENTS

| | | | |
|---|---|---|---|
| 1107481 | 5/1961 | Fed. Rep. of Germany . | |
| 1184592 | 12/1964 | Fed. Rep. of Germany | 148/6.15 Z |
| 3345498 | 7/1985 | Fed. Rep. of Germany . | |
| 889532 | 2/1962 | United Kingdom . | |
| 1413464 | 11/1975 | United Kingdom . | |
| 1591039 | 6/1981 | United Kingdom . | |
| 2072225 | 9/1981 | United Kingdom . | |
| 2078788 | 1/1982 | United Kingdom . | |
| 2080835 | 2/1982 | United Kingdom . | |
| 2169620 | 7/1986 | United Kingdom . | |

*Primary Examiner*—Sam Silverberg
*Attorney, Agent, or Firm*—Felfe & Lynch

[57] ABSTRACT

Disclosed is a process of producing a phosphate coating on a metal having a surface which consists at least in part of iron or steel. The metal is contacted at a temperature in the range from 30° to 50° C. with a phosphatizing solution which contains 5 to 25 g/l zinc, 1 to 10 g/l manganese, 0.1 to 13 g/l iron(II), 5 to 40 g/l phosphate (calculated as $P_2O_5$), 5 to 50 g/l nitrate, and which also contains 0.5 to 5 g/l fluoroborate (calculated as $BF_4$), and 0.05 to 3 g/l tartaric acid and/or citric acid. The solution has been adjusted to weight ratios of $Zn:P_2O_5=(0.5 \text{ to } 3):1$ and of $Mn:Zn=(0.04 \text{ to } 0.5):1$ and to a ratio of free acid to total acid of (0.04 to 0.2):1.

It is preferred to add nickel, copper and/or calcium to the phosphatizing solution and to adjust it to a content of Fe(II) not in excess of 10 g/l. The process is particularly suitable for preparing metals for cold working.

12 Claims, No Drawings

PROCESS OF PRODUCING PHOSPHATE COATINGS ON METALS

BACKGROUND OF INVENTION

The present invention is in a process for producing a phosphate coating on a metal having a surface which consists at least in part of iron or steel by a treatment with an aqueous phosphatizing solution, which contains zinc ions, manganese ions, $PO_4$ ions, nitrate ions and if being in working condition, iron(II) ions and to the use of that process for preparing metals for subsequent cold working.

It is known to phosphatize metals, particularly iron and steel, by a treatment with phosphatizing solutions which contain manganese, iron(II) and zinc phosphate and are at temperatures of from 50° to 98° C. The phosphate coatings thus obtained are suitable for all fields of application which are known in phosphatizing technology, such as rust prevention, priming for the application of paint, electric insulation, reducing sliding friction and facilitating cold working (Published German Application No. 30 23 479; EP No. 42 631).

The performance of the known processes at relatively low temperatures, e.g., between 30° and 50° C., often gives rise to difficulties which reside, among others, in the formation of incompletely covering phosphate coatings which become progressively coarser as the iron(II) content in the phosphatizing solution increases. Certain improvements can be obtained by a preliminary activating rinsing step, e.g., with titanium phosphate, but the results thus produced are not entirely satisfactory. On the other hand, low-temperature processes are urgently required because they save energy. Additionally, the processes which involve the presence of iron(II) are superior to the use of phosphatizing solutions which are free of iron(II) because much less sludge is formed and the consumption rates are favorable.

THE INVENTION

It is an object of the invention to provide a process for the production of phosphate coatings on metals having surfaces which consist at least in part of iron and steel, which process can be carried out at low temperatures and in the presence of iron(II) and which results in the formation of uniformly covering phosphate coatings but without an unusually high process expenditure.

It is a further object of the invention to provide a process for the preparation of such a metal surface for cold working.

The process of the invention accomplishes the above-described objects and others in that the metal is contacted with a phosphatizing solution which is at a temperature in the range from 30° to 50° C. and contains about 5 to about 25 g/l zinc, about 1 to about 10 g/l manganese, about 0.1 to about 13 g/l iron(II), about 5 to about 40 g/l phosphate (calculated as $P_2O_5$), about 5 to about 50 g/l nitrate, about 0.5 to about 5 g/l fluoroborate (calculated as $BF_4$) and about 0.05 to about 3 g/l tartaric acid and/or citric acid and which has been adjusted to weight ratios of $Zn:P_2O_5$ of (0.5 to 3):1 and of Mn:Zn of (0.04 to 0.5):1 and to a ratio of free acid to total acid of (0.04 to 0.2):1.

The process in accordance with the invention is particularly used to treat iron and steel which contain up to about 5% alloying additions. It also is possible to treat other metals, e.g., of zinc and zinc alloys, together with iron and steel, whether such other metals are in the form of compact workpieces or merely coatings on workpieces.

The several components of the phosphatizing solution, such as zinc, manganese, phosphate, etc., are jointly predissolved to form an acid phosphatizing concentrate, as is usual in phosphatizing technology, and are added to the phosphatizing solution in that form. The several components are added in such quantities that the required concentration ranges are obtained in the phosphatizing solution. In order to adjust the required ratio of free acid to total acid it may be necessary to use additional ions of the group consisting of the alkali and ammonium ions.

In a preferred embodiment of the invention, the metal is contacted with a phosphatizing solution which also contains about 0.05 to about 2 g/l Ni and/or about 0.001 to about 0.1 g/l Cu and/or about 0.5 to about 2 g/l Ca. A nickel content will promote the formation of the layer, particularly on materials which have a relatively high resistance to the attack by the solution and on zinc. An addition of copper ions will accelerate the phosphatizing process. Added calcium ions will modify the phosphate coating and will effect such a conditioning of the bath sludge formed in a small amount that the sludge is still less disturbing in the phosphatizing bath and can be removed from the system more easily.

The phosphatizing solutions used in the process in accordance with the invention need not initially contain iron(II) ions. That component will necessarily become enriched in the bath during the treatment of iron and steel by dissolution of iron from the surface. The phosphatizing may also be artificially aged by addition of an iron(II) salt compatible with the other components of the solution, e.g., iron(II) nitrate. While an iron(II) content of up to about 13 g/l is tolerable, the phosphatizing solutions are preferably used in such a manner that the concentration of iron(II) ions does not exceed 10 g/l.

In order to prevent an increase of the iron(II) concentration above that value, a portion of the iron(II) ions which have entered the solution as a result of the pickling action are preferably oxidized to form iron(III) ions. The iron(III) ions are precipitated as difficultly soluble iron(III) phosphate sludge.

In a preferred embodiment of the invention, surplus iron(II) is transformed to trivalent iron by contact with an oxygen-containing gas or by means of chlorate and is precipitated as iron(III) phosphate sludge. In the first case, iron(II) can be removed, e.g., in a separate aerating container, which is succeeded by a filter.

During the phosphatizing process, components of the solution are consumed by the formation of the coating, the formation of sludge, and by the mechanical discharge of phosphatizing solution. The consumed components must be replenished to the phosphatizing solution in the form of separate components or of replenishing concentrate containing a number of or all, of the individual components. The phosphatizing solution can be replenished in a particularly desirable manner by an addition of zinc ions, manganese ions, phosphate ions and nitrate ions in the form of at least one concentrate which has been adjusted to weight ratios of $Zn:P_2O_5$=(0.3 to 0.8):1, of Mn:Zn=(0.01 to 0.05):1 and of $NO_3:P_2O_5$=(0.2 to 1):1. Any other components of the phosphatizing solution to be replenished should be added in weight ratios of Ca:Zn=(0.005 to 0.1):1, of Ni:Zn=(0.005 to 0.05):1, of Cu:Zn=(0.001 to 0.03):1, of (tartaric acid and/or citric acid):$P_2O_5$=(0.05 to 0.3):1 and of $BF_4$:$P_2O_5$=(0.008 to 0.04):1.

Manganese carbonate, zinc oxide and/or zinc carbonate are preferably used to adjust the ratio of free acid to total acid to (0.04 to 0.2):1. These components are added to the phosphatizing solution as a powder or in an aqueous suspension. To determine the contents of free acid and of total acid, bath samples of 10 ml are titrated with N/10 NaOH to the first and second transitions of phosphoric acid indicated by a color change, e.g., from dimethyl yellow (free acid test) and phenolphthalein (total acid test) used as indicators. The consumption of N/10 NaOH in milliliters corresponds to the points of free acid or total acid.

It has also been found desirable to contact the metals with a phosphatizing solution which contains a nitrite-destroying substance, such as urea or amidosulfonic acid. This will inhibit the autocatalytic formation of nitrite from the nitrate and will preclude a turnover of the bath from the iron side to the nitrite side.

The metal surface may be contacted with the phosphatizing solution by dipping, flooding or spraying. In most cases the solution is applied by dipping with treatment times of, e.g., 5 to 15 minutes. If the flooding technique is used the treating time is the same as with the dipping treatment. In case of spraying the treatment time is in general in the range of 0.5 to 3 minutes.

In dependence on the specific composition of the solution, the treating temperature, the treating time and the sequence of operations, the phosphate layers produced by the process in accordance with the invention will have a weight of about 3 to 15 g/m$^2$.

Before the phosphatizing process, the metals are pretreated in the conventional manner. For instance, the metals may be degreased by means of an aqueous alkaline cleaning solution which suitably contains surfactants. Any scale or rust which may be present should be removed by a pickling treatment, e.g., with sulfuric acid or hydrochloric acid.

Before the workpieces are phosphatized, they may be prerinsed in a manner known per se, e.g., with an activating bath which contains titanium phosphate, in order to promote the formation of finely crystalline phosphate coatings. Such a treatment is not compulsory.

The phosphatizing treatment is usually succeeded by a rinsing with water and by an optional aftertreatment and drying, if required. The resistance to corrosion can be increased by an aftertreatment, e.g., with chromic acid and/or corrosion protective emulsions. Workpieces to be cold-worked may be aftertreated, e.g., with a soap-applying bath.

The phosphate coatings produced by the process in accordance with the invention can be used to advantage in all fields in which phosphate coatings are used and are particularly suitable for preparing metals for a subsequent cold working.

The invention will be explained more in detail and by way of example with reference to the Example.

EXAMPLE

Steel wire having a carbon content from 0.5 to 0.9% by weight was dipped into hydrochloric acid to remove rust and scale and was then thoroughly rinsed with water. The rinsed wire was phosphatized by dipping for 6 to 10 minutes in a phosphatizing solution which was at 45° C. and composed as follows:

| | |
|---|---|
| 10.9 g/l | Zn, |
| 2.1 g/l | Mn, |
| 2.0 g/l | Fe(II), |
| 0.5 g/l | Ca, |
| 0.5 g/l | Ni, |
| 0.01 g/l | Cu, |
| 0.3 g/l | Na, |
| 24.0 g/l | $NO_3$, |
| 10.6 g/l | $P_2O_5$, |
| 1.6 g/l | $BF_4$, |
| 1.6 g/l | tartaric acid, |
| 0.5 g/l urea, | |
| 4.7 points free acid, and | |
| 40.7 points total acid. | |

The phosphatizing treatment was succeeded by another rinsing with water, which was followed by neutralization in a hot aqueous borax solution and by oven-drying. After that sequence of steps, the phosphate coating had a weight of 8 to 10 g/m$^2$. Although there had been no activating prerinse with titanium phosphate, the phosphate coating provided a uniform coverage and was finely crystalline.

After that treatment the wires could be satisfactorily shaped in up to 10 drawing passes to a maximum reduction in cross-section by 93.5% with a very low wear of the drawing dies. After drawing, the surface of the wire continued to have a uniform residual phosphate layer and was free of grooves.

Air was blown into the phosphatizing bath during the treatment to maintain the iron(II) ion content in the range from 2 to 7 g/l under the existing conditions. To maintain as constant the points of total acid in the bath, the solution was replenished with a replenishing concentrate containing, on a weight percent basis:

| | |
|---|---|
| 11.4% | Zn, |
| 0.26% | Mn, |
| 0.13% | Ca, |
| 0.11% | Ni, |
| 0.025% | Cu, |
| 22.9% | $P_2O_5$, |
| 10.3% | $NO_3$, |
| 2.6% | tartaric acid, |
| 0.38% | $BF_4$, and |
| 0.26% | urea. |

Because the bath was operated on the iron side, only a small amount of bath sludge was formed. Replenishing concentrate was consumed at the very low rate of 20 g per m$^2$ of metal surface area.

It will be understood that the specification and examples are illustrative but not limitative of the present invention and that other embodiments within the spirit and scope of the invention will suggest themselves to those skilled in the art.

We claim:

1. A process for producing a phosphate coating on a metal having a surface which consists at least in part of iron or steel comprising: contacting said metal surface with an aqueous phosphatizing solution which is at a temperature in the range from 30° to 50° C. containing about 5 to about 25 g/l zinc, about 1 to about 10 g/l manganese, about 0.1 to about 13 g/l iron(II), about 5 to about 40 g/l phosphate (calculated as $P_2O_5$, about 5 to about 50 g/l nitrate, about 0.5 to about 5 g/l fluoroborate (calculated as $BF_4$), about 0.05 to about 3 g/l tartaric acid and/or citric acid, the phosphatizing solution having weight ratios of Zn:$P_2O_5$=(0.5 to 3):1, of Mn:Zn=(0.04 to 0.5):1 and a ratio of free acid to total acid of (0.04 to 0.2):1.

2. The process of claim 1 wherein the metal is contacted with a phosphatizing solution which also contains about 0.05 to about 2 g/l Ni and/or about 0.001 to about 0.1 g/l Cu and/or about 0.5 to about 2 g/l Ca.

3. The process of claim 1 wherein the metal is contacted with a phosphatizing solution which has been adjusted to an Fe(II) concentration not in excess of 10 g/l.

4. The process of claim 1 wherein the phosphatizing solution is contacted with an oxygen containing gas to transform surplus iron(II) to Fe(III) and to precipitate the latter as iron(III) phosphate sludge.

5. The process of claim 1 wherein the metal is contacted with a phosphatizing solution in which surplus iron(II) is reacted with chlorate to form iron(III).

6. The process of claim 5 wherein the iron(III) is precipitated as iron(III) phosphate sludge.

7. The process of claim 1 wherein the phosphatizing solution is replenished by an addition of zinc ions, manganese ions, phosphate ions and nitrate ions in the form of at least one concentrate which has been adjusted to weight ratios of $Zn:P_2O_5$=(0.3 to 0.8) 1, of Mn:Zn=(0.01 to 0.05):1 and of $NO_3:P_2O_5$=(0.2 to 1):1.

8. The process of claim 1 wherein the phosphatizing solution is replenished by an addition of Ni, Cu, Ca, tartaric acid and/or citric acid as well as fluoborate in weight ratios of Ca:Zn=(0.005 to 0.1):1, of Ni:Zn=(0.005 to 0.05):1, of Cu:Zn=(0.001 to 0.03):1, of (tartaric acid and/or citric acid):$P_2O_5$=(0.05 to 0.3):1 and of $BF_4:P_2O_5$=(0.008 to 0.04):1.

9. The process of claim 1 wherein the metal is contacted with a phosphatizing solution having a free acid content that has been adjusted by an addition of manganese carbonate, zinc oxide and/or zinc carbonate.

10. The process of claim 1 wherein the metal is contacted with a phosphatizing solution which contains a nitrite-destroying substance.

11. The process of claim 10 wherein the nitrite-destroying substance is at least one selected from the group consisting of urea and amidosulfonic acid.

12. A process of preparing a metal for cold working comprising: contacting said metal surface with an aqueous phosphatizing solution which is at a temperature in the range from 30° to 50° C. containing about 5 to about 25 g/l zinc, about 1 to about 10 g/l manganese, about 0.1 to about 13 g/l iron(II), about 5 to about 40 g/l phosphate (calculated as $P_2O_5$), about 5 to about 50 g/l nitrate, about 0.5 to about 5 g/l fluoroborate (calculated as $BF_4$), about 0.05 to about 3 g/l tartaric acid and/or citric acid, the phosphatizing solution having weight ratios of $Zn:P_2O_5$=(0.5 to 3):1 and of Mn:Zn=(0.04 to 0.5):1 and a ratio of free acid to total acid of (0.04 to 0.2):1.

* * * * *